US007676924B2

(12) United States Patent
Stadler et al.

(10) Patent No.: US 7,676,924 B2
(45) Date of Patent: Mar. 16, 2010

(54) GASIFIER

(75) Inventors: Jacobus Andreas Stadler, Secunda (ZA); Zbigniew Franciszek Matyja, Secunda (ZA)

(73) Assignee: Sasol-Lurgi Technology Company (Proprietary) Ltd., Johannesburg (ZA)

( * ) Notice: Subject to any disclaimer, the term of this patent is extended or adjusted under 35 U.S.C. 154(b) by 403 days.

(21) Appl. No.: 11/568,071

(22) PCT Filed: Nov. 15, 2005

(86) PCT No.: PCT/IB2005/003401

§ 371 (c)(1),
(2), (4) Date: Oct. 19, 2006

(87) PCT Pub. No.: WO2006/054139

PCT Pub. Date: May 26, 2006

(65) Prior Publication Data

US 2007/0240364 A1 Oct. 18, 2007

(30) Foreign Application Priority Data

Nov. 17, 2004 (ZA) ..... 2004/9224

(51) Int. Cl.
*B21D 53/02* (2006.01)

(52) U.S. Cl. ..... 29/890.03; 29/980.03; 48/197 R; 165/151; 165/154; 165/180; 165/177; 165/181; 165/182

(58) Field of Classification Search ..... 29/890.07; 48/197 R; 165/201, 151, 154
See application file for complete search history.

(56) References Cited

U.S. PATENT DOCUMENTS

| | | | | |
|---|---|---|---|---|
| 2,879,660 | A | 3/1959 | Reintjes | |
| 3,829,285 | A * | 8/1974 | Beck | 432/223 |
| 5,015,178 | A | 5/1991 | Hystad et al. | |

FOREIGN PATENT DOCUMENTS

| | | |
|---|---|---|
| CN | 2354008 Y | 12/1999 |
| FR | 686733 | 7/1930 |

OTHER PUBLICATIONS

International Preliminary Report on Patentability, dated May 22, 2007 for International Application No. PCT/IB2005/003401.

* cited by examiner

*Primary Examiner*—Jennifer Michener
*Assistant Examiner*—Kaity V. Handal
(74) *Attorney, Agent, or Firm*—Sutherland Asbill & Brennan, LLP

(57) ABSTRACT

A method of constructing an inner thermal lining or jacket of a jacketed gasifier having an outer shell with an opening allowing access to an interior of the gasifier, includes inserting jacket wall segments (40) into the gasifier interior through the opening, the jacket wall segments (40) each comprising an elongate jacket plate (42) with an annulus face (44) and a plurality of transversely extending longitudinally spaced stiffener formations (46) standing proud of the annulus face (44). The jacket wall segments (40) are arranged side by side leaving an aperture or space between adjacent jacket plates. The stiffener formations (46) of adjacent spaced jacket wall segments are welded together through the aperture or space between said adjacent spaced jacket wall segments, and the apertures or spaces are closed with window plates.

10 Claims, 4 Drawing Sheets

GASIFIER

TECHNICAL FIELD

THIS INVENTION relates to gasifiers. In particular, the invention relates to jacketed gasifiers and to a method of constructing an inner thermal lining of a jacketed gasifier.

BACKGROUND OF THE INVENTION

Fixed bed gasifiers, such as fixed bed dry bottom gasifiers, are also known as moving bed gasifiers or moving bed dry ash gasifiers.

Fixed bed jacketed gasifiers, such as Sasol-Lurgi fixed bed dry bottom gasifiers are being used commercially to gasify carbonaceous material such as coal to produce raw synthesis gas. Such a jacketed gasifier comprises an outer shell or pressure vessel and an inner thermal lining or jacket, which between them define an annulus or jacket space. In use, boiler feed water circulates through the annulus or space or cavity between the jacket and the outer shell by thermosyphon effect, producing saturated steam as a result of heat transfer through the jacket driven by the heat generated through the gasification process occurring inside the gasifier. The inner thermal lining or jacket is subjected to loading and stress as a result of external pressure (in use, the pressure in the annulus or jacket space is typically higher than the gasifier operating pressure), residual installation stresses, thermal fatigue, thermal expansion, clinker crushing and localised hot spots. As a result, the outer shell typically outlasts the jacket and it becomes necessary from time to time to replace the jacket, or at least a cylindrical wall thereof between top and bottom end components. Typically, the annulus or jacket space is inaccessible from outside the gasifier, i.e. welding of jacket components is only possible from inside the gasifier. This invention thus provides, inter alia, a method of constructing an inner thermal lining of a jacketed gasifier, which method can be used to replace the jacket, or portions of the jacket, of a jacketed gasifier.

SUMMARY OF THE INVENTION

According to one aspect of the invention, there is provided a method of constructing an inner thermal lining or jacket of a jacketed gasifier which includes an outer shell or pressure vessel with an opening allowing access to an interior of the gasifier, the method including inserting jacket wall segments into the gasifier interior through the opening, the jacket wall segments each comprising an elongate jacket plate with an annulus face and a plurality of transversely extending longitudinally spaced stiffener formations standing proud of the annulus face;

arranging the jacket wall segments side by side leaving an aperture or space between adjacent jacket plates;

welding the stiffener formations of adjacent spaced jacket wall segments together through the aperture or space between said adjacent spaced jacket wall segments;

closing the apertures or spaces with window plates and welding longitudinally extending edges of adjacent spaced jacket plates to the intervening window plates to form part of a cylindrical jacket wall; and welding the jacket wall to top and bottom jacket end components.

Preferably, the jacket plates have a thickness of less than 25 mm, more preferably less than 18 mm, even more preferably less than 15 mm, e.g. about 12 mm. Advantageously, the thinner the jacket plates the less the thermal stresses are to which the jacket plates are subjected in use, but the jacket plates must be thick enough to form a jacket wall which can withstand the differential pressure across the wall. Using the transversely extending longitudinally spaced stiffener formations, the inventors have surprisingly found that jacket plates as thin as 13 mm or 12 mm can be used, in contrast to conventional 32 mm or 25 mm thick jacket plates.

Said annulus faces are typically convexly curved and the stiffener formations are typically part annular, comprising a radial flange on the annulus face of a jacket plate and an end flange arranged perpendicularly to the radial flange, i.e. concentric with and facing the curved annulus face of the jacket plate.

The radial flange may be apertured to allow passage through the radial flange of a coolant flowing through the annulus or jacket space.

Preferably at least 25%, more preferably at least 35%, most preferably at least 40%, e.g. 50%, of each radial flange is void.

The stiffener formations may be welded together with full penetration welds and may be welded together without backing strips.

The welding of the longitudinally extending edges of adjacent spaced jacket plates to the intervening window plate may be effected without backing strips. In other words, all vertical welds may be effected without backing strips, advantageously reducing longitudinal seam welding compared to conventional methods of which the inventors are aware.

Each jacket wall segment may include top and bottom transition plates or portions to facilitate welding of the jacket wall to the top and bottom jacket end components. These transition plates or portions are typically thicker than the jacket plates, as are the top and bottom jacket end components, e.g. 32 mm or 40 mm. The transition plates or portions may be wider than the jacket plates.

The invention extends to a jacketed gasifier with an inner thermal lining or jacket constructed in accordance with the method as hereinbefore described and including jacket wall segments welded to intervening window plates and including adjacent stiffener formation segments which are joined together to form stiffener formations inside a jacket space.

According to another aspect of the invention, there is provided a jacketed gasifier which includes an outer shell or pressure vessel and an inner thermal lining or jacket defining a gasification zone, an annulus or jacket space for a coolant being defined between the outer shell and the jacket; and circumferentially extending vertically spaced stiffener formations mounted to the jacket, in the annulus or jacket space.

The gasifier may be a fixed bed gasifier and may thus include a carbonaceous material inlet, an ash outlet, a raw synthesis gas outlet and a gasification agent inlet in communication with the gasification zone. The gasifier may also include a rotatable grate above the ash outlet.

Typically, the coolant is boiler feed water, with the gasifier in use producing saturated steam in the annulus or jacket space. The gasifier thus typically includes a boiler feed water inlet and a steam outlet in communication with the annulus or jacket space.

The inner thermal lining or jacket may include a cylindrical jacket wall comprising jacket wall segments and jacket end components, as hereinbefore described. The jacket wall may have a minimum thickness of less than 25 mm, more preferably less than 18 mm, even more preferably less than 15 mm, e.g. about 12 mm or 13 mm.

The stiffener formations may be as hereinbefore described.

These and other features of the present application will become apparent to one of ordinary skill in the art upon review of the following detailed description when taken in conjunction with the drawings and the appended claims.

BRIEF DESCRIPTION OF THE DRAWINGS

The invention will now be described, by way of example, with reference to the accompanying diagrammatic drawings in which.

DETAILED DESCRIPTION OF THE INVENTION

Figure 1:
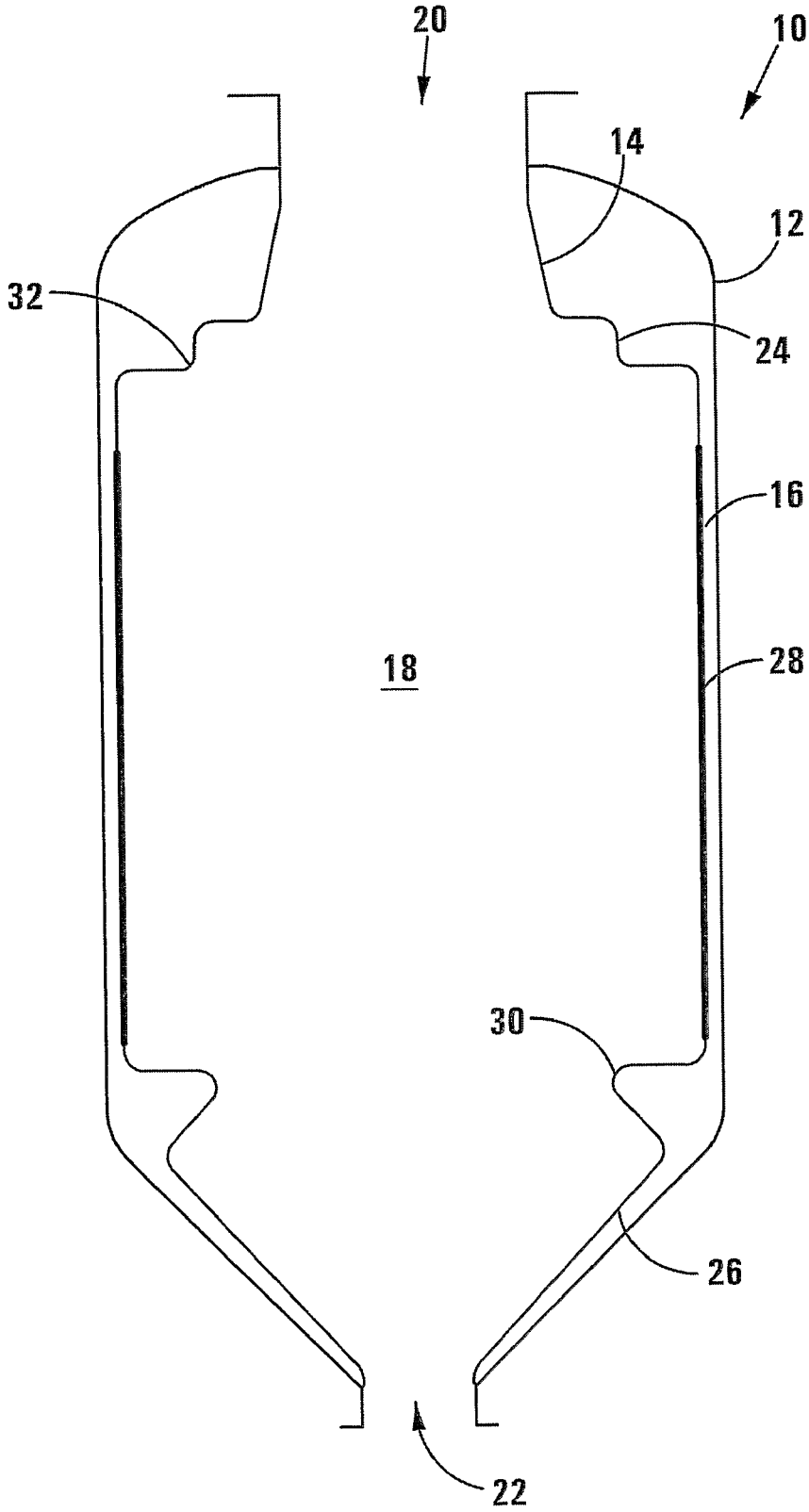
FIG. 1 shows a schematic vertical section of a jacketed fixed bed gasifier with parts omitted for clarity.

Referring to FIG. 1 of the drawings, reference numeral 10 refers generally to a pressurised fixed bed dry bottom jacketed gasifier with many components or parts omitted for clarity. The gasifier 10 comprises an outer shell or pressure vessel 12 and an inner thermal lining or jacket 14 located inside the outer shell 12. Between the outer shell 12 and the jacket 14, an annulus or jacket space 16 is defined. The jacket 14 defines a gasification zone 18 in which coal can be gasified. A coal inlet 20 and an ash outlet 22 are provided for feeding coal into the gasification zone 18 and for removing ash from the gasification zone 18. Typically, the coal is fed through a coal lock (not shown) and the ash is removed by means of a rotatable grate (not shown in FIG. 1 but illustrated as 19 in FIG. 2 which also shows a coal distributor 21) and an ash lock (not shown).

The jacket 14 comprises a top jacket end component 24, a bottom jacket end component 26 and a circular cylindrical jacket wall 28 extending vertically between the top jacket end component 24 and the bottom jacket end component 26. In FIG. 1, the cylindrical jacket wall 28 is shown with bold lines for clarity. The bottom jacket end component 26 defines a bottom knuckle 30 and the top jacket end component 24 defines a top knuckle 32.

In use, coarse coal is fed through a coal lock or a lock hopper (not shown) into the gasification zone 18, with steam and oxygen (gasification agent) being fed along a steam and oxygen feed line (not shown) and typically distributed through the rotatable grate. Oxygen is required to combust some of the coal to supply energy for the endothermic gasification reactions. During gasification of the coal, steam is produced in the jacket space 16 due to heat transfer through the jacket wall 28. This steam is removed from the jacket space 16 by means of a steam outlet (not shown) at a position above the top knuckle 32. Water which is not converted into steam is carried over into a dam region located above the top knuckle 32. This carried-over water is then fed back to the bottom of the gasifier via three 3 inch downcomer pipes (not shown), and re-enters the jacket space 16 between the bottom knuckle 30 and the outer shell 12. The water converted into steam (and removed from the system) is replaced by boiler feed water which is added at the top of each downcomer pipe. The boiler feed water is at a temperature of approximately 105° C. The mixture of re-circulated water and boiler feed water enters the gasifier at a temperature of approximately 215° C. This mixture then flows up through the jacket space 16 by means of thermosyphon effect and is heated to approximately 235° C. producing saturated steam at a pressure of about 2970 kPa. Typically, part of the steam that is generated is returned to the gasifier 10 as gasification agent.

In the gasification zone 18, different reaction zones are distinguishable from top to bottom, namely a drying zone where moisture is released, a devolatilisation zone where pyrolysis takes place, a reduction zone where mainly the endothermic reactions occur, an exothermic oxidation or combustion zone, and an ash bed at the bottom of the gasification zone 18. As a result of the counter-current mode of operation, hot ash exchanges heat with cold incoming reagents, such as steam and oxygen or air, while at the same time hot raw synthesis gas exchanges heat with cold incoming coal. This results in the ash and raw gas, respectively leaving the gasification zone at relatively low temperatures compared to other types of gasifiers, which improves the thermal efficiency and lowers the steam and oxygen consumption of the gasifier.

Figure 2:
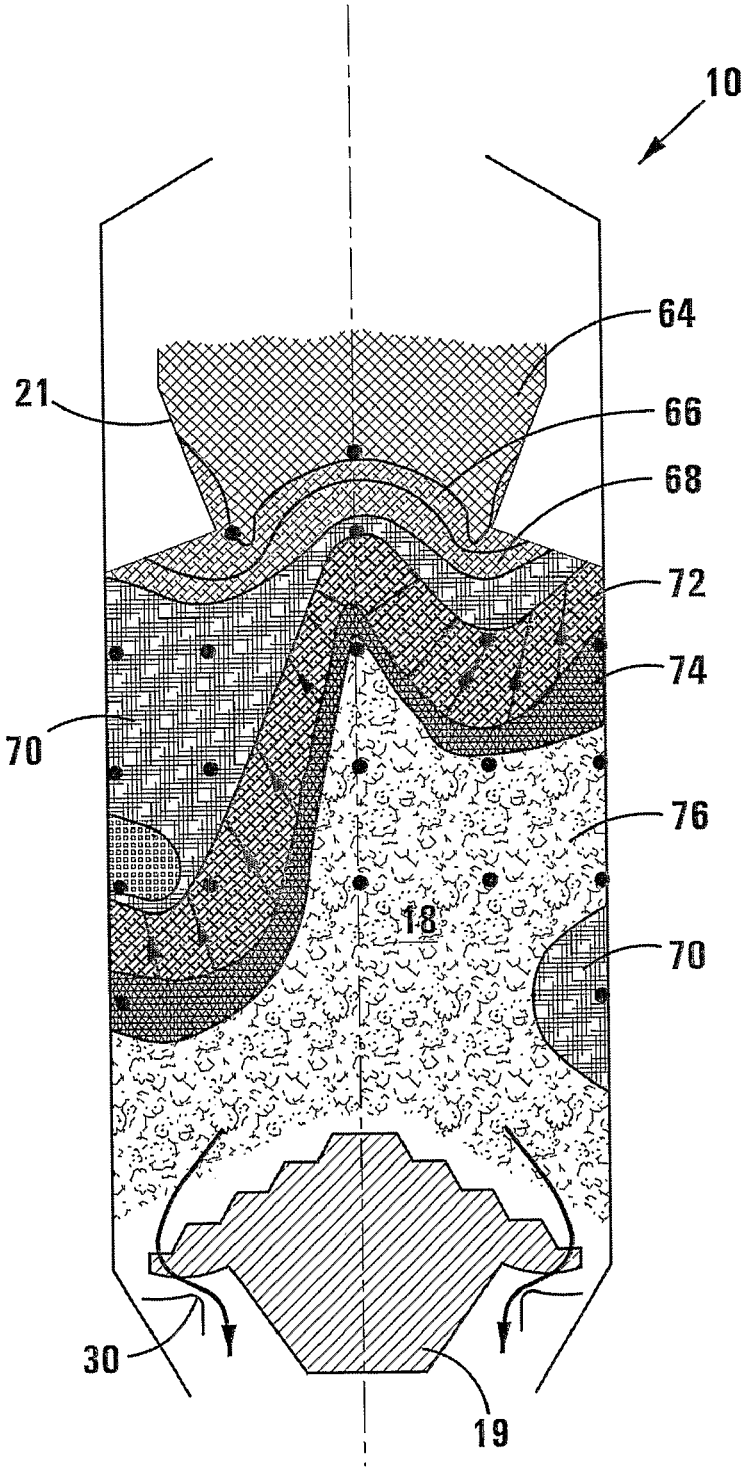
FIG. 2 shows a typical temperature footprint of a jacketed fixed bed gasifier.

The temperature profile in the gasifier 10 varies as the coal moves through the different reaction zones in the gasification zone 18, first as a coal bed and then as an ash bed. With reference to FIG. 2 of the drawings, a typical gasifier temperature footprint is shown. In a zone 64 (inside the coal distributor 21) temperatures of less that 200° C. are experienced. In zones 66 and 68 temperatures vary respectively between about 200° C. and 400° C. and 400° C. and 600° C. In zones 70, temperatures between about 600° C. and 800° C. are experienced. Temperatures of between about 800° C. and 1000° C. are experienced in a zone 72, with temperatures in excess of 1000° C. being experienced in a zone 74. Reference numeral 76 indicates an ash bed.

The zone 74 represents a fire-bed. As can be clearly seen in FIG. 2, the fire-bed has a varying thickness or depth and a roughly W-shaped profile. Peripheral zones of the gasification zone 18 are typically unstable and very sensitive to changes in grate speed, gasification agent flow and gasification agent ratio. In contrast, a central zone of the gasification zone 18 is typically observed as a relatively stable zone, keeping its position as shown after the gasifier 10 has reached an equilibrium. This zone is not sensitive to changes in grate speed, gasification agent flow and gasification agent ratio.

The 600° C. to 800° C. hot spot represented by the zone 70 in the lower right-hand portion of the gasification zone 18 appears randomly in the ash bed 76. It is believed that this hot spot can be attributed to coal which did not completely react in the fire-bed zone 74 and then reacts upon contact with oxygen at this random position in the ash bed 76.

The temperature of the fire-bed 74 is approximately 1400° C. to 1450° C. depending on ash fusion temperature and steam fraction in the gasification agent feed. The fire-bed height is estimated to be maximum 0.5 m in thickness or depth and fluctuates under typical local channeling conditions. The raw synthesis gas disengages the coal bed at between about 450° C. and 550° C. whereas ash leaves the gasifier 10 at a temperature of between about 300° C. and 380° C.

The gasifier 10 typically operates at an operating pressure of about 2900 kPa. The differential pressure across the jacket 14 is thus typically about 70 kPa. The jacket 14 is exposed to material at the temperatures of the zones as shown in FIG. 2. Actual metal temperatures of the jacket 14 are however not only determined by temperatures inside the gasification zone 18, but also by the cooling effect of the boiling water in the jacket space 16. Typically, actual metal temperatures vary between about 200° C. and 400° C., although the inventors' understanding of high heat flux densities and cooling system limitations, as well as actual thermocouple measurements have indicated that peak metal temperatures exceed 750° C. from time to time.

As will be appreciated, as a result of the varying temperature footprint inside the gasification zone 18, external pressure, residual installation stresses, thermal fatigue, etc., the jacket 14 is subjected to loading and stress. The jacket 14, and in particular the cylindrical jacket wall 28, thus warps and buckles over time and it becomes necessary from time to time to replace the jacket 14, or at least the cylindrical jacket wall 28. Access to the interior of the gasifier 10, i.e. the gasification zone 18, can be obtained through the coal inlet 20. Welding and other work can thus be carried out on the jacket 14 from inside the gasification zone 18. It is however not practical to perform work on the jacket 14 from outside the gasifier 10 as the jacket 14 is protected by the outer shell 12.

Figure 3:
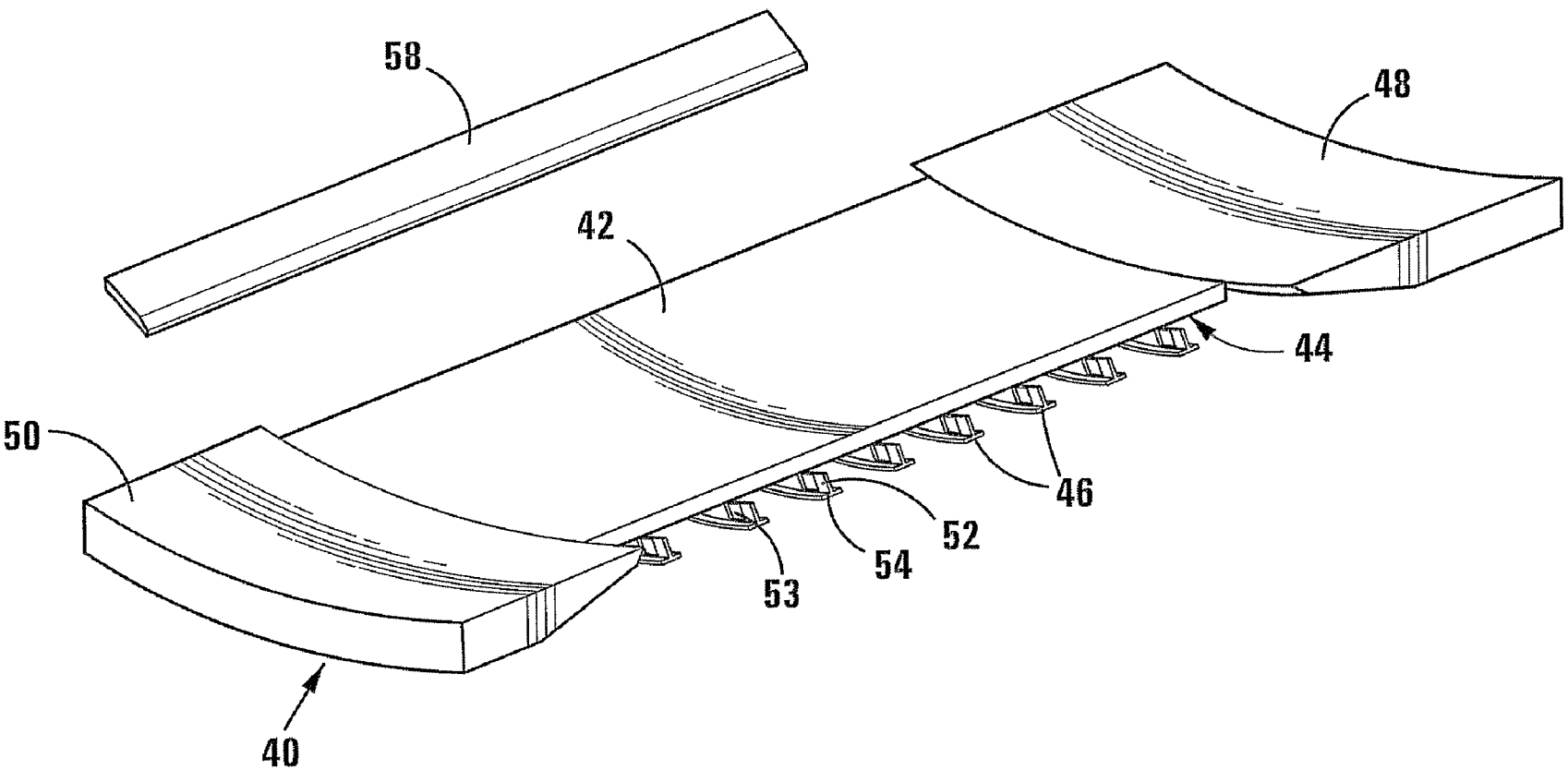
FIG. 3 shows a three-dimensional view of a jacket wall segment and a window plate used in the method of the invention to construct an inner thermal lining of a jacketed gasifier.

The jacket wall 28 typically comprises a plurality of elongate vertically extending wall segments and by replacing the jacket wall segments the cylindrical jacket wall 28 can be replaced, thereby extending the useful operating life of the gasifier 10. In accordance with the invention, the jacket wall segments are replaced with jacket wall segments 40 as shown in FIG. 3 of the drawings. Each jacket wall segment 40 comprises an elongate curved jacket plate 42 with a convexly curved annulus face 44 to which eight transversely extending longitudinally spaced T-shaped stiffener formations 46 have been welded. The stiffener formations 46 stand proud of the annulus face 44. Each jacket wall segment 40 further comprises a top transition plate 48 and a bottom transition plate 50 welded to ends of the jacket plate 42.

The jacket plate 42 has a thickness of about 12 mm. The top transition plate 48 gradually increases in thickness from where it is welded to the jacket plate 42 to reach a thickness of about 32 mm. The bottom transition plate 50 gradually increases in thickness from where it is welded to the jacket plate 42 to reach a thickness of about 40 mm. The top transition plate 48 thus has the same material thickness as the top jacket end component 24 and the bottom transition plate 50 has the same material thickness as the bottom jacket end component 26. The top and bottom transition plates 48, 50 are wider than the jacket plate 42 and the jacket plate 42 and top and bottom transition plates 48, 50 thus define an I when seen in front or rear view.

Figure 4:
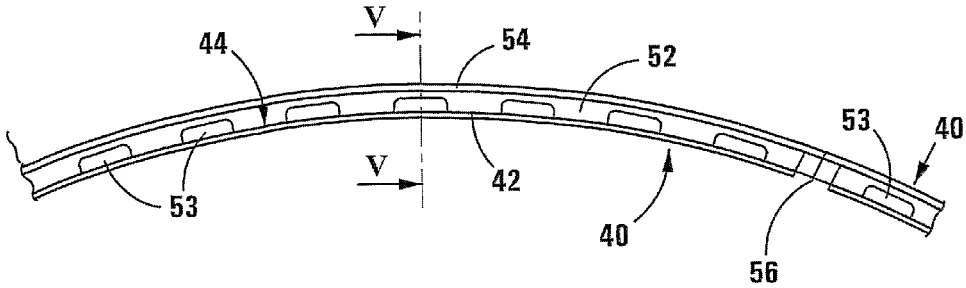
FIG. 4 shows a top plan view of the jacket wall segment of FIG. 3, with a top transition plate omitted for clarity, fitted next to a similar jacket wall segment.
Figure 5:
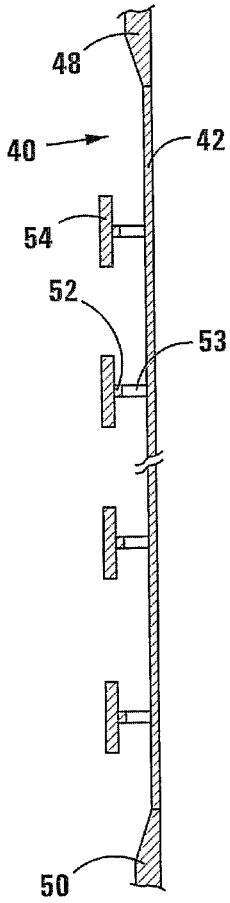
FIG. 5 shows a longitudinal section through the jacket wall segment of FIG. 3, taken at V-V in FIG. 4.

Each stiffener formation 46 comprises a part annular radial flange 52 welded to the annulus face 44 of the jacket plate 42 and an end flange 54 arranged at right angles to the radial flange 52 and welded to the radial flange 52. A plurality of apertures or slots 53 are provided in the radial flange 52 so that about 50% of the radial flange 52 is void. The stiffener formations 46 end in line with sides of the top and bottom transition plates 48, 50. Thus, when two jacket wall segments 40 are placed adjacent to one another, the top transition plates 48, bottom transition plates 50 and stiffener formations 46 of the adjacent jacket wall segments 40 are in contact but an aperture or window is defined between the adjacent jacket plates 42. This aperture or window is indicated by reference numeral 56 in FIG. 4 of the drawings. As will be appreciated, it is thus possible to obtain access to the stiffener formations 46 through the aperture 56 and a person working inside the gasification zone 18 can weld the stiffener formations 46 of adjacent jacket wall segments 40 together, via the aperture 56. Typically, full penetration welds are used to weld the stiffener formations 46 of adjacent jacket wall segments 40 together, without making use of any backing strips.

Once all the stiffener formations 46 of adjacent jacket wall segments 40 have been welded together, the aperture 56 is closed by means of a window plate 58 as shown in FIG. 3 of the drawings. Typically, the window plate 58 has a width of about 135 mm. Longitudinally extending edges of adjacent spaced jacket plates 42 are welded to longitudinally extending edges of the window plate 58 and the top and bottom transition plates 48, 50 of adjacent jacket wall segments 40 are welded together, thereby forming the cylindrical jacket wall 28. Typically, the welding of the longitudinally extending edges of adjacent spaced jacket plates 42 to the intervening window plate 58 is effected without backing strips. The top and bottom transition plates 48, 50 of all the jacket wall segments 40 are welded respectively to the top jacket end component 24 and the bottom jacket end component 26 to complete the jacket 14. Typically, this welding involves backing strips. Smooth grinding of all welds is done and the refurbished gasifier 10 is then subjected to pressure testing.

The construction method of the invention, as illustrated, effectively allows thinner jacket plates 42 to be used while still producing a jacket 14 which has sufficient strength to prevent buckling under the design operating differential pressure of the jacket 14. Boiler feed water circulation is not adversely affected as a result of the apertures 53 in the radial flanges 52. Heat flux through the jacket 14 is improved. The method of the invention drastically reduces field welding requirements relating to reduced residual stresses and in situ out of roundness deformation. The stiffener formations 46 do not introduce any dead zones into the jacket space 16 and no static build-up of steam around the apertures 53 in the radial flanges 52 is expected. Longitudinal seam welding is reduced by up to 55% compared to conventional jacket construction methods of which the inventors are aware, translating into improved refurbishment time.

It should be apparent that the foregoing relates only to the preferred embodiments of the present application and that numerous changes and modifications may be made herein without departing from the general spirit and scope of the invention as defined by the following claims and the equivalents thereof.

The invention claimed is:

1. A method of constructing an inner thermal lining or jacket of a jacketed gasifier which includes an outer shell or pressure vessel with an opening allowing access to an interior of the gasifier, the method including:

inserting jacket wall segments into the gasifier interior through the opening, the jacket wall segments each comprising an elongate jacket plate with an annulus face and a plurality of transversely extending longitudinally spaced stiffener formations standing proud of the annulus face;

arranging the jacket wall segments side by side leaving an aperture or space between adjacent jacket plates;

welding the stiffener formations of adjacent spaced jacket wall segments together through the aperture or space between said adjacent spaced jacket wall segments;

closing the apertures or spaces with window plates and welding longitudinally extending edges of adjacent spaced jacket plates to the intervening window plates to form part of a cylindrical jacket wall; and welding the jacket wall to top and bottom jacket end components.

2. The method as claimed in claim 1, in which the jacket plates have a thickness of less than 25 mm.

3. The method as claimed in claim 2, in which the jacket plates have a thickness of less than 18 mm.

4. The method as claimed in claim 1, in which said annulus faces are convexly curved and in which the stiffener formations are part annular, comprising a radial flange on the annulus face of a jacket plate and an end flange arranged perpendicularly to the radial flange, i.e. concentric with and facing the curved annulus face of the jacket plate.

5. The method as claimed in claim 4, in which the radial flange is apertured to allow passage through the radial flange of a coolant flowing through the annulus or jacket space.

6. The method as claimed in claim 5, in which at least 25% of each radial flange is void.

7. The method as claimed in claim 1, in which the stiffener formations are welded together with full penetration welds without backing strips.

8. The method as claimed in claim 1, in which the welding of the longitudinally extending edges of adjacent spaced jacket plates to the intervening window plate is effected without backing strips.

9. The method as claimed in claim 1, in which the gasifier is a fixed bed gasifier.

10. A jacketed gasifier with an inner thermal lining or jacket constructed in accordance with the method as claimed in claim 1 and including jacket wall segments welded to intervening window plates and including adjacent stiffener formation segments which are joined together to form stiffener formations inside a jacket space.

* * * * *

UNITED STATES PATENT AND TRADEMARK OFFICE

CERTIFICATE OF CORRECTION

PATENT NO. : 7,676,924 B2
APPLICATION NO. : 11/568071
DATED : March 16, 2010
INVENTOR(S) : Stadler et al.

It is certified that error appears in the above-identified patent and that said Letters Patent is hereby corrected as shown below:

Title Page, should read -
(73) Assignee: Sasol Technology (Proprietary) Limited

Signed and Sealed this
First Day of March, 2011

David J. Kappos

David J. Kappos
*Director of the United States Patent and Trademark Office*